United States Patent [19]

Haines

[11] Patent Number: 4,544,320

[45] Date of Patent: Oct. 1, 1985

[54] REFUSE CONTAINER

[76] Inventor: Allan B. Haines, 24 Highfield Ave., St. Georges, State of South Australia, Australia

[21] Appl. No.: 516,756

[22] Filed: Jul. 25, 1983

[51] Int. Cl.[4] ..... B65F 3/28

[52] U.S. Cl. ..... 414/511; 414/517

[58] Field of Search ..... 414/511, 517, 509

[56] References Cited

U.S. PATENT DOCUMENTS 2,934,226 4/1960 Dempster et al. ..... 414/517

FOREIGN PATENT DOCUMENTS 383656 9/1973 U.S.S.R. ..... 414/517

*Primary Examiner*—Robert G. Sheridan

*Attorney, Agent, or Firm*—Bert J. Lewen; Henry Sternberg

[57] ABSTRACT

An improved refuse compactor comprising a compactor body, a pusher blade assembly longitudinally movable back and forth along approximately the whole length of the chamber, a carriage behind the pusher blade and also being guided for longitudinal back and forth movement along approximately half the length of the chamber, a first pair of fluid cylinders operatively associated between the carriage and the pusher blade, and a second pair of fluid cylinders operatively associated between the front end of the compaction chamber and the carriage, the arrangement being such that compacted waste material within the chamber is ejected by firstly actuating one pair of the cylinders and then the other said pair.

7 Claims, 5 Drawing Figures

REFUSE CONTAINER

Figure 1:
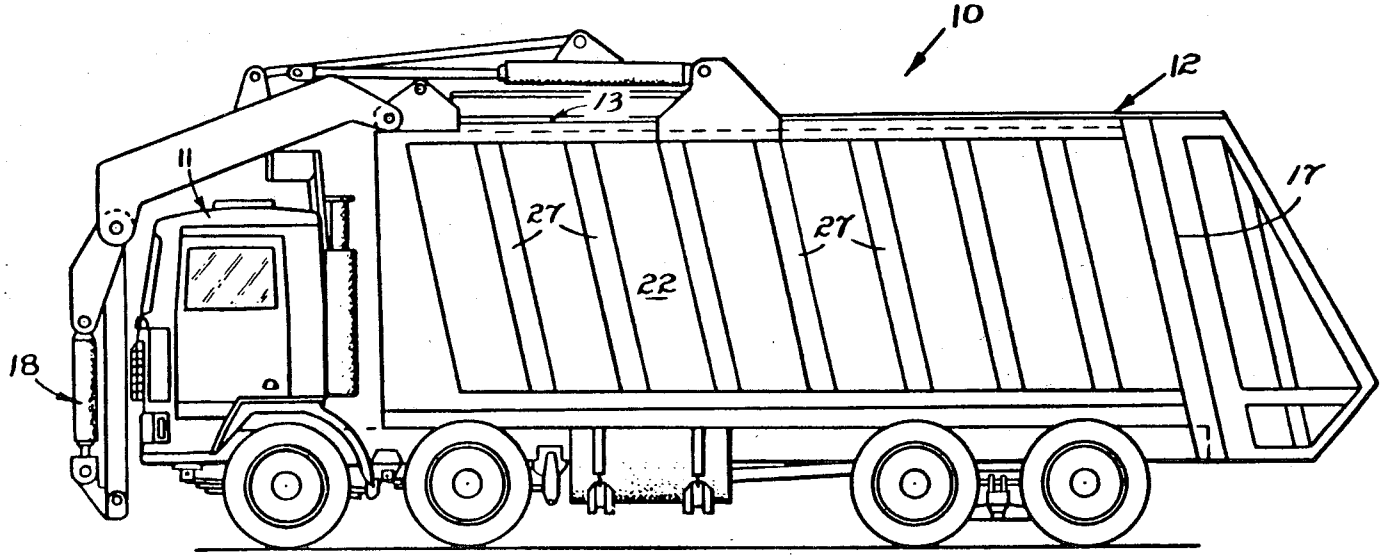

This invention relates to an improved refuse compactor, and more specifically to an improved refuse compactor unit adapted to be secured to a vehicle chassis.

Many forms of refuse compactors are known in the art. In general, they comprise a bin or container having a waste material inlet opening, a discharge opening remote from the inlet opening, and a packer or pusher blade which is coupled to a hydraulic ram which, when actuated, tightly packs or compresses the waste material deposited in the bin or container. In order to eject the compacted refuse or waste material, the closure door closing the discharge opening is opened and thus allows the compacted waste material to be discharged from the container by the pusher blade. The compactors can be either stationary, that is located on-site in an area where waste material and the like is to be compacted, or mobile—with the compactor unit mounted on the chassis of a vehicle for example a truck. In the latter situation, the compactor is also provided with mechanical means for collecting and depositing waste material into the interior of the unit.

Two well known mobile refuse compactor systems are known to the applicant. The first system, referred to in the art as "Full Pack", incorporates a pusher or packer blade which extends across the entire width of the container, and which is arranged to travel the full length of the compactor, being operated by a very large telescopic hydraulic ram. Such a system possesses the advantages in that (a) the unit is stable at all times by having the compactor bin or container fixed to the chassis of the vehicle, (b) the ejection of the compacted refuse is effected by opening the rear door of the compactor container and operating the pusher or packer blade to its fully extended position at the rear of the container to eject the entire contents of the container, and (c) the unit being a fixture to the truck, the weight thereof is kept as low as possible. The disadvantages associated with such a system are the relatively poor compaction ratios on account of the single cylinder operation and the high repair costs on the large telescopic hydraulic cylinder.

The other system, referred to in the art as "Half Pack", incorporates a similar packing or pusher blade which travels approximately half the length of the compactor body during compaction, and is usually operated by twin, single-stage hydraulic cylinders. This system possesses the advantages of excellent compaction ratio due to utilising a twin cylinder operation, a relatively quick packing cycle due to the half pack ram stroke, and relatively low maintenance costs on the single stage hydraulic cylinders. A serious problem however, associated with such a system, is its instability during the ejection of the compacted waste material. In this system ejection of the waste material is achieved by opening the rear door of the compactor bin or container, tilting the compactor container by raising the front thereof by means of hydraulic rams to an angle of approximately 45 degrees whereupon the refuse normally falls under gravity out of the container. The tipping ejection operation not only is time consuming but also can be somewhat dangerous in situations where the vehicle is operated on uneven ground and an instance is known where a vehicle has rolled over in the elevated tipping position resulting in loss of life. Furthermore, such a system necessitates the use of an undercarriage assembly for effecting the lifting/tipping action of the container.

It is the main object of the present invention to provide a refuse compactor which obviates the problems associated with the prior art arrangements, and in accordance with this invention an improved refuse compactor comprises a compactor body having walls defining a compaction chamber into which waste material is deposited and compacted by a packer or pusher blade assembly arranged to be guided for longitudinal back and forth movement along the length of the chamber for firstly compacting the waste material deposited in the chamber and subsequently ejecting the compacted waste material from a discharge opening at the rear of the chamber characterised by a carriage located rearwardly of said pusher blade and guided for longitudinal back and forth movement between a retracted position near the front of the compaction chamber and an extended position intermediate the front and rear ends of said compaction chamber, a first pair of fluid cylinders operatively interconnected between said carriage and said pusher blade arranged, upon actuation thereof, to urge the pusher blade away from said carriage to permit the pusher blade to compact waste material within the chamber, and a second pair of fluid cylinders operatively interconnected between the compaction chamber at or near the front thereof and said carriage for effecting movement of said carriage between its said retracted position and its said extended position during which said movement the pusher blade and the carriage move together, the arrangement being such that compacted waste material within the compaction chamber can be ejected therefrom by firstly actuating said first pair of fluid cylinders to urge said pusher blade away from the carriage to an approximate midway position along the compaction chamber, and secondly by actuating said second pair of fluid cylinders to urge said carriage to its said intermediate position and simultaneously urge the pusher blade to a position adjacent the discharge opening of said compaction chamber.

In a preferred form, the fluid cylinders of each said pair of cylinders comprise hydraulic rams arranged in scissors fashion, each having its cylinder and piston rod ends pivotally mounted to respective vertical pivots to thereby enable the ends thereof to pivot during both the extension and retraction stroke of the ram. Preferably, the hydraulic rams are located in two horizontal planes with one ram from each pair of rams located in one horizontal plane, and the other ram of each pair located in the other horizontal plane.

With this invention, the following advantages are evidence:

(a) Significantly greater stability is afforded to a mobile unit due to the fact that the compactor body can be fixed to the chassis of the vehicle and is not required to be tilted to effect the ejection of the compacted waste material;

(b) The compaction operation utilising a pair of single stage hydraulic rams in a scissors action (these being the rams interconnected between the carriage and the pusher blade) provides excellent compaction ratios;

(c) The ejection of the compacted refuse is both quick and safe, and (d) The simplicity of the design construction affords for lower maintenance/repair costs.

Figure 2:
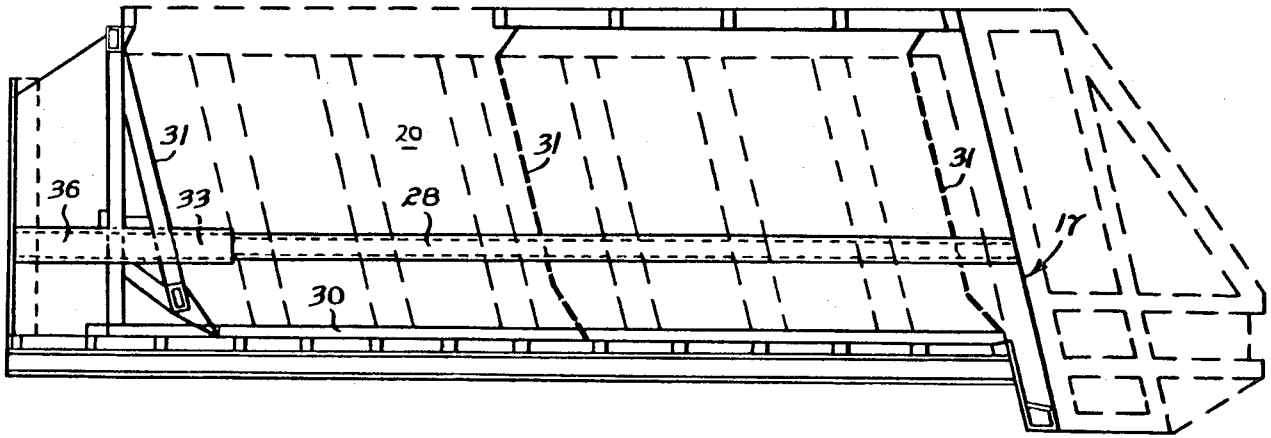
Figure 3:
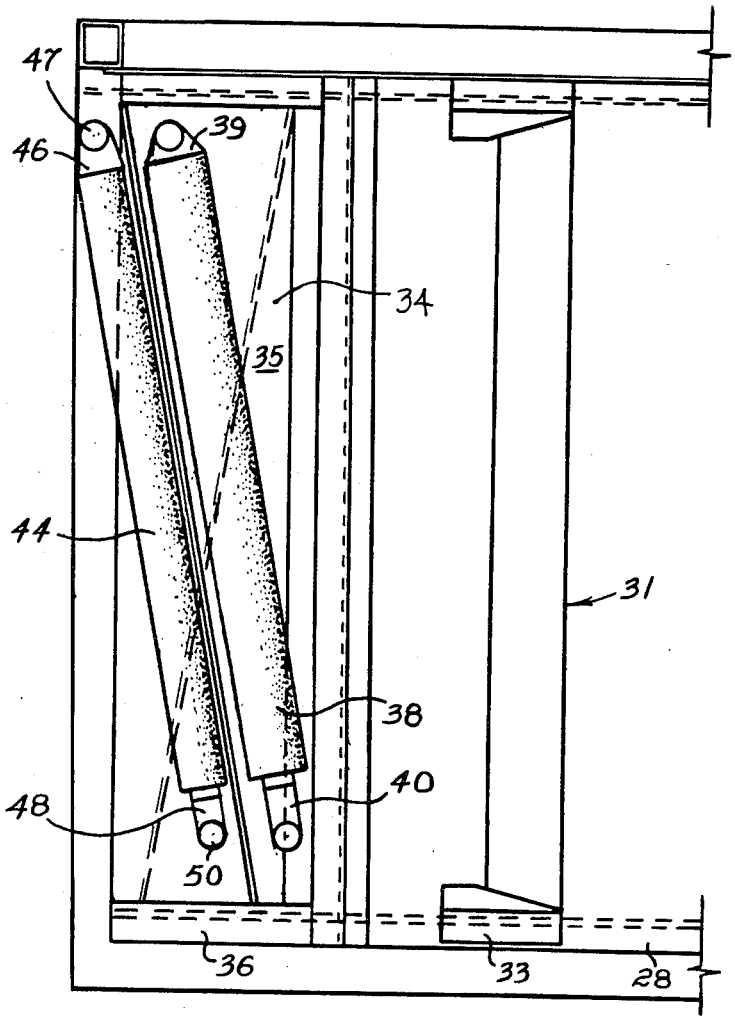
Figure 4:
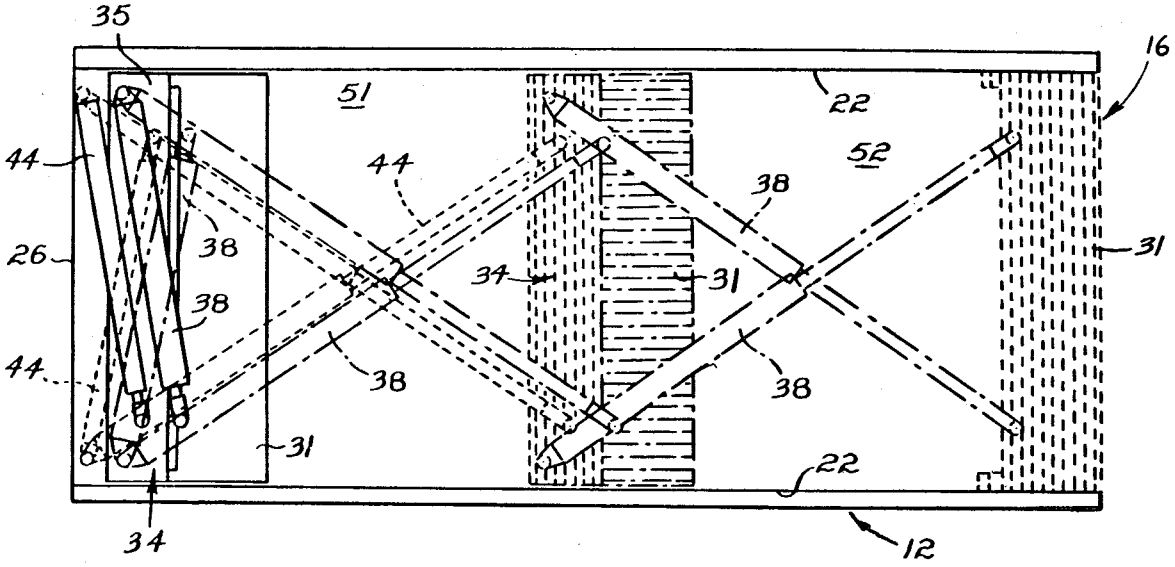
Figure 5:
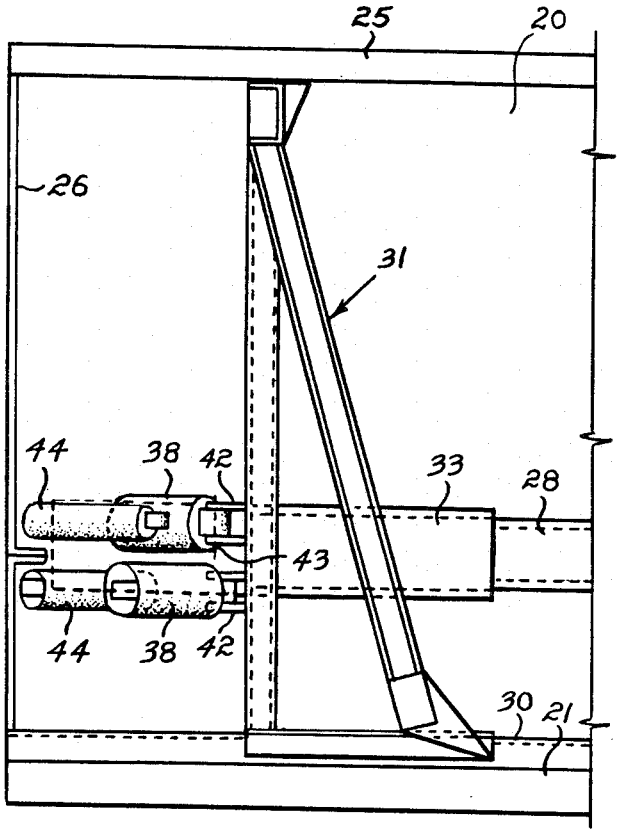

In order to more fully explain the applicant's invention, an embodiment is described hereunder in some further detail with reference to and illustrated in the accompanying drawings in which:

FIG. 1 is an elevation of a mobile refuse compactor vehicle incorporating the present invention, FIG. 2 is a partly schematic side elevation of the refuse container showing the packer blade in its fully retracted, intermediate and fully extended positions, (the latter two positions being dotted), FIG. 3 is a fragmentary plan view of the refuse container showing two of the actuating rams on the topside of the carriage, FIG. 4 is a schematic plan view showing the "compaction" rams and the "dump" rams in their different operating positions (the -.-.- lines showing the "compaction" rams and the packer blade extended to the "maximum compaction position, and the --- lines showing the "dump" rams, the carriage and the blade extended to the refuse "ejection" position), and FIG. 5 is a framgentary side view which omits the carriage for the sake of clarity.

In this embodiment, a mobile refuse compactor vehicle 10 comprises a truck cabin 11 behind which is mounted a container 12 secured to the chassis of the vehicle. The container 12 is provided with an access opening 13 in the top thereof adjacent its forward end for introducing waste material thereinto, and also a discharge opening 16 which is normally closed by a closure plate or door 17. The vehicle 10 is also provided with means 18 for collecting the waste material located in front of or alongside of the vehicle 10 and lifting same to a position where it is located over the access opening 13 whereupon it can then be tilted and deposited into the container 12. Such collecting means is in accordance with prior art and does not form any part of this invention.

The container 12 mounted on the chassis of the truck at the rear thereof defines an enclosed chamber 20 having a floor 21, sides 22, a top wall 25 which is provided with the access opening 13, a closed front end 26 and an open rear end forming the discharge opening 16. For the purpose of rigidity, stiffening ribs 27 are provided on the sides 22 of the container 12.

Extending along the inner side walls of the chamber 20 is a pair of horizontally aligned channel section guide tracks 28 which are secured in position by welding. The horizontal guide tracks 28 extend for approximately the whole length of the compaction chamber 20. A further channel section guide track 30 extends longitudinally along the floor 21 of the chamber 20 centrally thereof.

As with prior art arrangements, the chamber 20 houses a transversely extending, inclined packer or pusher blade 31, the length and height of which approximates respectively to the internal width and height of the chamber 20. The sides and bottom of the packer blade 31 are provided with suitably shaped slots or cut-outs which engage over the channel section guide tracks 28, 30 to thereby guide the packer blade 31 for back and forth sliding movement along the length of the compaction chamber 20. In this embodiment, so as to minimise lateral play of the pusher blade ends, there are provided longitudinal channel guides 33 which are secured by welding, to the walls defining the cut-outs so that their channels face outwardly, the guides 33 slidably engaging over the guide tracks 28 along the sides of the chamber 20.

In contra-distinction to prior art arrangements, the packer blade 31 of this invention is coupled to a carriage 34 comprising a reinforced flat transverse plate 35 which extends across the chamber 20, the ends of the carriage plate 35 having secured thereto outwardly facing channel shaped guide members 36 which slidably engage over the guide tracks 28 to thus longitudinally guide the carriage 34 for back and forth movement within the chamber 20. As shown in FIG. 2, the leading ends of the guides 36 on the carriage 34 abut against the trailing ends of the guides 33 secured to the pusher blade 31, when the carriage and blade are fully retracted.

The pusher blade 31 and the carriage 34 are operatively coupled together by means of a first pair of single stage double acting hydraulic rams 38 (referred to hereinafter as the "compaction" rams), each of the rams 38 having its cylinder end 39 pivotally mounted to the carriage 34 adjacent one side of the chamber 20 and its piston rod end 40 pivotally mounted to the pusher blade 31 at the rear thereof, this pivot connection being located near the opposite side of the chamber 20. As shown in FIG. 5, the pivot connection comprises a clevis 42 and a vertical pivot pin 43 which passes through an apertured lug on the cylinder and piston rod ends. In this embodiment, the "compaction" rams 38 are arranged in scissors fashion, each in a respective horizontal plane, the piston rod end pivotal connection to the pusher blade 31 being located slightly below the central horizontal plane of the pusher blade 31 to assist in minimising twisting of the blade during use.

A second pair of single stage double acting hydraulic rams 44, referred to hereinafter as "dump" or "ejection" rams, are operatively coupled to the carriage 34 and which are arranged, upon actuation thereof, to drive the carriage 34, along with the pusher blade 31, to a position approximately midway between the front and rear ends of the compaction chamber 20. Each of the dump cylinders 44 has its cylinder end 46 pivotally mounted to a fixed pivot mounting 47 on the inside of the front wall 26 of the container 12 and its piston rod end 48 to a pivot 50 carried on the carriage 34. The pair of "dump" cylinders 44 are also disposed in horizontal planes one above the other in a scissors-like arrangement. In this embodiment, one ram from each of the pairs of rams 38, 44 lie in one horizontal plane above the carriage plate 35 whilst the other ram of each pair 38, 44 lie in the other horizontal plane below the carriage plate 35.

Levers (not shown) are provided to selectively control the actuation of the two sets of hydraulic rams 38, 44.

The operation of the compactor is as follows:

During the normal load compaction cycle, refuse or waste material is introduced through the access opening 13 in the top of the container 12 and deposited into the loading section thereof with the pusher blade 31 in its fully retracted position (see FIG. 4) where it is located near the front of the compaction chamber 20. Actuation of the "compaction" cylinders or rams 38 urges the pusher blade 31 through the loading compartment 51 of the container to compact the refuse material into the compaction compartment 52 of the container, the rear opening of the chamber 20 being closed. During this cycle, the "compaction" cylinders 38 move approximately half the length of the chamber 20 and the "dump" cylinders 44 are inoperative. This cycle is repeated until such time as the compaction compartment 52 is fully loaded and the operator requires the compacted refuse to be ejected from the container 12. The rams 38 together with the pusher blade 31 are returned to their retracted positions.

To initiate the ejection cycle, the operator actuates the "compaction" cylinders 38 to thereby cause the packer blade 31 to move once again away from the carriage 34 to its approximate central position within the chamber (see FIG. 4). The "dump" cylinders 44 are then actuated so as to pivot same away from the chamber front wall 26 and in turn simultaneously move the carriage 34 and the blade 31 through the chamber rearwardly, the compaction cylinders 38 being held in their extended condition during such movement. The pusher blade 31 is thus caused to move through to the end of the chamber 20 and eject the entire contents compacted within the container 12 (refer FIG. 4). Of course, prior to actuating the "dump" cylinders 44, the rear door 17 is opened to allow the compacted material to be ejected through the discharge opening 16.

It should of course be readily appreciated that the sequence of operation of the rams 38, 44 may be reversed in effecting the ejection cycle. That is, the rams 44 may be actuated to move the carriage 34 and blade 31 together to their midway position in the chamber, followed by actuation of the "compaction" rams 38 to move the blade 31 away from the carriage to its fully extended ejection position. Either sequence can be used but will normally depend upon the relative sizes of the rams employed.

With the rams 38, 44 arranged in scissors fashion in respective horizontal planes, it will be appreciated that as the pusher blade 31 moves through the compaction chamber 20, the cylinders rotate about their pivot points to allow for the extension of their piston rods. In so doing, the horizontal component of force applied to the pusher blade 31 increases as the cylinder stroke increases.

It will be seen therefore that the ejection cycle of the compacted refuse material within the compactor body is a two-stage operation which involves the actuation of one of the pairs of cylinders 38, 44 to extend the pusher blade 31 to its maximum compaction position, which would normally be approximately midway between the end walls of the chamber 20, followed by the actuation of the other pair of cylinders 38, 44 to extend the pusher blade 31 to a position near to or adjacent the discharge opening 16 of the compaction chamber.

In a variation of the above embodiment, the carriage 34 and the pusher blade 31 are designed so that with the pusher blade in its fully retracted position, the carriage and the blade are closely nested together, this being effective to conserve space and to maximize the compaction stroke of the compaction cylinders.

A brief consideration of the above embodiment will indicate that the invention provides for significant improvements in refuse compactors. The compactor of this invention possesses the advantages of high compaction ratios and speedy compaction cycle times, low maintenance/repair costs (as only single stage hydraulic rams are required), overall light weight which provides for greater pay-loads within legal limits, and safer refuse dumping action.

I claim:

1. An improved refuse compactor of the type comprising a compactor body having walls defining a compaction chamber into which waste material is deposited and compacted by a packer or pusher blade assembly arranged to be guided for longitudinal back and forth movement along the length of the chamber for firstly compacting the waste material deposited in the chamber and subsequently ejecting the compacted waste material from a discharge opening at the rear of the chamber characterised by a carriage located rearwardly of said pusher blade and guided for longitudinal back and forth movement between a retracted position near the front of the compaction chamber and an extended position intermediate the front and rear ends of said compaction chamber, a first pair of fluid cylinders operatively interconnected between said carriage and said pusher blade and arranged, upon actuation thereof, to urge the pusher blade away from said carriage to permit the pusher blade to compact waste material within the chamber, and a second pair of fluid cylinders operatively interconnected between the compaction chamber at or near the front thereof and said carriage for effecting movement of said carriage between its said retracted position and its said extended position during which said movement the pusher blade and the carriage move together, wherein each said fluid cylinder has its cylinder end and its piston rod end pivotally mounted for pivotal movement about a vertical axis and wherein each said pair of fluid cylinders has its cylinders disposed in a scissors arrangement with one cylinder from each said pair of cylinders lying in a first horizontal plane above the plane of the carriage, and the other cylinder of the said pair of cylinders lying in a second horizontal plane below the plane of the carriage, the arrangement being such that compacted waste material within the compaction chamber can be ejected therefrom by actuating said first pair of fluid cylinders to urge said pusher blade away from the carriage to an approximate midway position along the compaction chamber, and by actuating said second pair of fluid cylinders to urge said carriage to its said intermediate position and simultaneously urge the pusher blade to a position adjacent the discharge opening of said compaction chamber.

2. An improved refuse compactor according to claim 1 wherein said refuse compactor body is mounted on a chassis of a vehicle.

3. An improved refuse compactor according to claim 1 wherein each said cylinder is a single stage double acting hydraulic ram.

4. An improved refuse compactor accordingto claim 1 wherein said carriage comprises a transversely extending horizontal plate having a length which is slightly less than the width of the compaction chamber, said plate having secured at each of its ends, a longitudinally extending guide member of channel cross-sectional shape slidingly engageable along similar shaped guide tracks extending longitudinally along each side of the compaction chamber.

5. An improved refuse compactor according to claim 1 wherein said carriage in its extended position is located approximately midway along the compaction chamber.

6. An improved refuse compactor according to claim 2 wherein each fluid cylinder of said first pair of cylinders has its piston rod end pivotally mounted to the pusher blade assembly at a location below the central horizontal plane of the pusher blade.

7. An improved refuse compactor according to claim 1 wherein the carriage is guided for longitudinal movement along the same guide tracks at the sides of the chamber which guide the movement of the pusher blade.

* * * * *